US008086162B2

(12) United States Patent
Kato

(10) Patent No.: US 8,086,162 B2
(45) Date of Patent: Dec. 27, 2011

(54) CLEANING BLADE AND IMAGE FORMING APPARATUS

(75) Inventor: Ken Kato, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 12/654,558

(22) Filed: Dec. 23, 2009

(65) Prior Publication Data

US 2010/0166472 A1 Jul. 1, 2010

(30) Foreign Application Priority Data

Dec. 25, 2008 (JP) ..... 2008-331094

(51) Int. Cl.
*G03G 21/00* (2006.01)

(52) U.S. Cl. ..... 399/350

(58) Field of Classification Search ..... 399/123, 399/343, 350, 351; 15/256.5, 256.53; 528/60, 528/65, 80

See application file for complete search history.

(56) References Cited

U.S. PATENT DOCUMENTS

| | | | | |
|---|---|---|---|---|
| 5,438,398 | A * | 8/1995 | Tanigawa et al. | 399/302 |
| 5,765,088 | A | 6/1998 | Nakayama et al. | |
| 6,473,589 | B2 * | 10/2002 | Hisakuni | 399/350 |
| 7,645,849 | B2 * | 1/2010 | Omori et al. | 528/60 |
| 2002/0041779 | A1 | 4/2002 | Hisakuni | |
| 2005/0268424 | A1 | 12/2005 | Omori et al. | |
| 2006/0004174 | A1 | 1/2006 | Omori et al. | |
| 2006/0140692 | A1 * | 6/2006 | Abe et al. | 399/350 |

FOREIGN PATENT DOCUMENTS

| | | |
|---|---|---|
| JP | 2000-172141 A | 6/2000 |
| JP | 2001-265190 | 9/2001 |

* cited by examiner

*Primary Examiner* — Hoan Tran
(74) *Attorney, Agent, or Firm* — Rabin & Berdo, PC

(57) ABSTRACT

A cleaning blade is disposed in an abutting relation with an image bearing body and configured to remove residual developer material from the image bearing body. The cleaning blade has a tan δ peak temperature equal to or higher than 8.6° C. and lower than 45° C., and any one of a Young's modulus equal to or higher than 13 Mpa and lower than 140 Mpa, a tensile strength equal to or higher than 37.3 Mpa and lower than 76 Mpa, a hardness equal to or higher than 83° and lower than 97°, and a tearing strength equal to or higher than 59 kgf/cm and lower than 118 kgf/cm.

23 Claims, 7 Drawing Sheets

CLEANING BLADE AND IMAGE FORMING APPARATUS

BACKGROUND OF THE INVENTION

1. Field of the Invention

The present invention relates to a cleaning blade and an image forming apparatus that incorporates the cleaning blade.

2. Description of the Related Art

A conventional image forming apparatus such as a printer, a facsimile machine, or a multifunction printer performs an electrophotographic process. A charging roller uniformly charges a surface of an image bearing body or a photoconductive drum. An LED head illuminates the charged surface to form an electrostatic latent image. A developing roller develops the electrostatic latent image with toner into a toner image. A transfer roller transfers the toner image onto print paper. The toner image on the print paper is then fixed into a permanent image. Some of the toner may remain on the photoconductive drum after transfer of the toner image onto the print paper. A cleaning device removes the residual toner from the photoconductive drum.

The cleaning device includes a plate-like cleaning blade formed of an elastic material such as urethane rubber. The edge of the cleaning blade is pressed against the surface of the photoconductive drum under pressure, thereby scraping the residual toner from the surface of the photoconductive drum as the photoconductive drum rotates.

The cleaning blade is designed to have a tan δ peak temperature below −10° C., so that the residual toner may be removed sufficiently under various conditions of the environment in which the printer is installed.

A cleaning blade having a tan δ peak temperature lower than −10° C. exhibits high molecular mobility in the temperature range in which the printer is installed. Thus, the cleaning blade exhibits the properties of rubber such as elasticity, flexibility, and softness.

While the cleaning blade in a rubber state may appear to be a mere solid object, the molecules of the rubber exhibit a certain level of motion (micro-Brownian motion), still allowing the molecular chains to deform or displace to some extent.

The cleaning blade in a rubber state is easy to stretch in a direction in which the surface of the photoconductive drum rotates, so that stick-slip motion of the cleaning blade is quite active and therefore external additive comes off from the toner particles and deposits on the photoconductive drum. Further, wax contained in the toner particles elutes and adheres to the surface of the photoconductive drum, leading to filming (OPC filming) on the surface of the photoconductive drum.

SUMMARY OF THE INVENTION

The present invention was made in view of the aforementioned drawbacks.

An object of the invention is to solve the problems with the prior art.

Another object of the invention is to provide a cleaning blade and an image forming apparatus in which filming on the surface of a photoconductive drum is minimized.

A cleaning blade is disposed in an abutting relation with an image bearing body and is configured to remove residual developer material from the image bearing body. The cleaning blade has a tan δ peak temperature equal to or higher than 8.6° C. and lower than 45° C., and any one of a Young's modulus equal to or higher than 13 Mpa and lower than 140 Mpa, a tensile strength equal to or higher than 37.3 Mpa and lower than 76 Mpa, a hardness equal to or higher than 83° and lower than 97°, and a tearing strength equal to or higher than 59 kgf/cm and lower than 118 kgf/cm.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limiting the present invention, and wherein.

DETAILED DESCRIPTION OF THE INVENTION

Embodiments of the invention will be described in detail with reference to the accompanying drawings.

First Embodiment

Figure 1A:
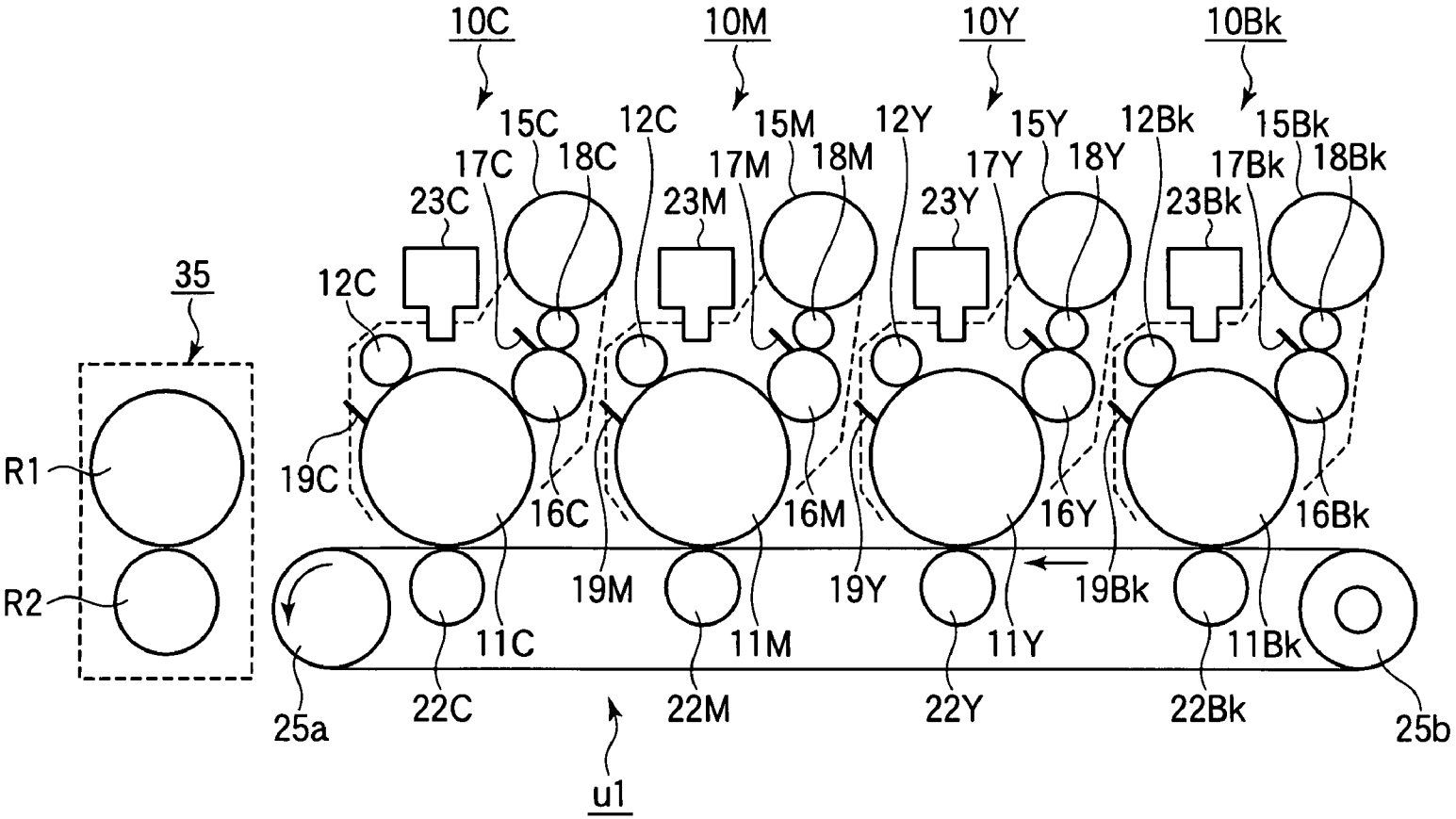
FIG. 1A illustrates the general configuration of an image forming apparatus of the invention.
Figure 1B:
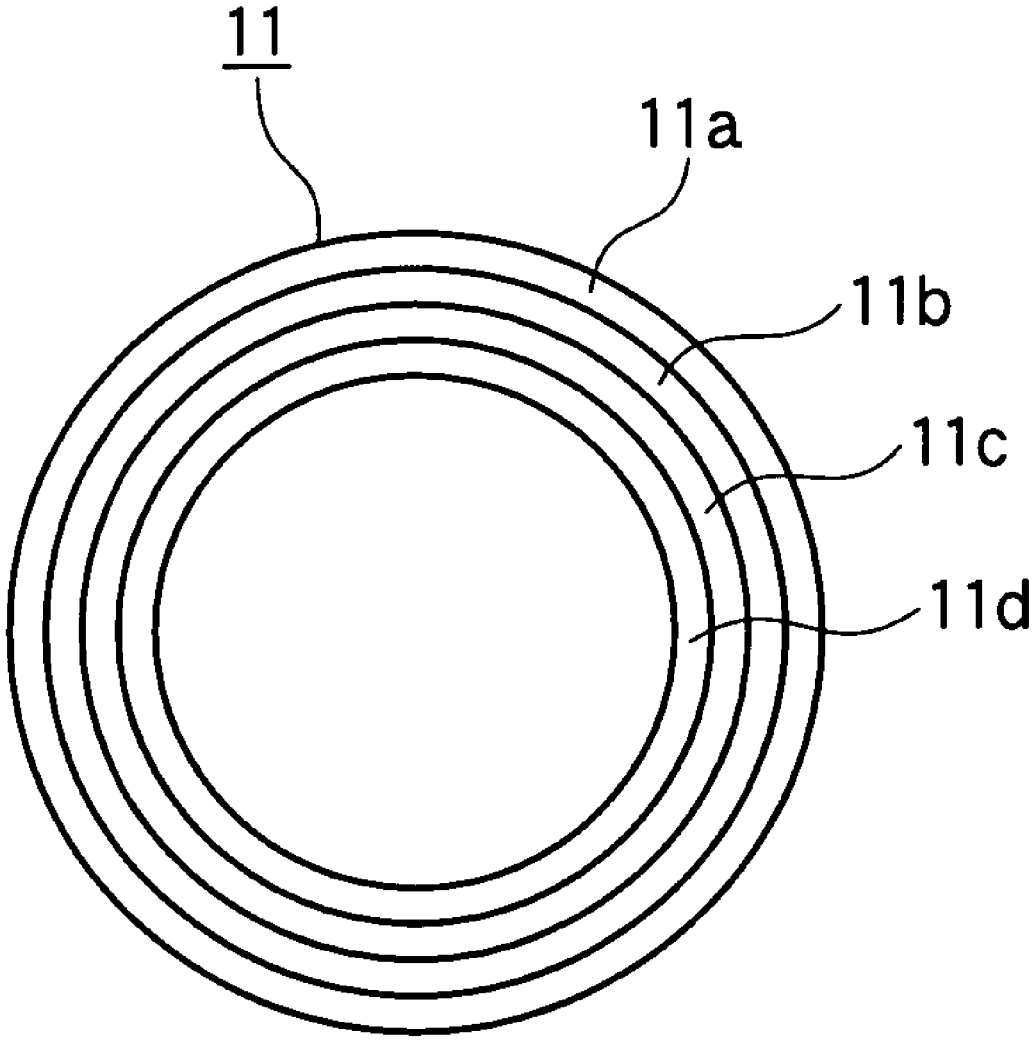
FIG. 1B illustrates the general configuration of a photoconductive drum.

FIG. 1A illustrates the general configuration of an image forming apparatus or a printer of the invention. FIG. 1B illustrates the configuration of a photoconductive drum.

Image forming sections or print engines 10BK, 10Y, 10M, and 10C form black, yellow, magenta, and cyan toner images, respectively. Exposing sections or LED heads 23BK, 23Y, 23M, and 23C are disposed to face image bearing bodies or photoconductive drums 11BK, 11M, and 11Y, respectively. The photoconductive drum includes an aluminum hollow core 11*d* covered with an under coat layer 11*c* (1-3 μm thick), a carrier generation layer 11*b* (0.2-0.3 μm thick), and a carrier transport layer 11 (approximately 18 μm thick) in this order. The under coat layer 11*c* is an insulating thin film that blocks injection of the charges. The carrier generation layer 11*b* causes the charges to be generated. The carrier transport layer 11*a* transports the charges. A transfer section or transfer unit U1 is disposed under the image forming sections 10BK, 10Y, 10M, and 10C and transfers the black, yellow, magenta, and cyan toner images onto the print paper. A fixing section or fixing device or a fixing unit 35 fixes the toner images on the print paper into a permanent full color image under heat and pressure.

The transfer unit U1 includes a drive roller 25*a*, a driven roller 25*b*, an endless belt 24 disposed about the drive roller 25*a* and driven roller 25*b*, a spring (not shown), and transfer rollers 22BK, 22Y, 22M, and 22C. The endless belt 24 transports the print paper thereon through the image forming sections 10BK, 10Y, 10M, and 10C. The spring maintains the endless belt 24 in tension. The transfer roller 22BK, 22Y, 22M, and 22C parallel the corresponding photoconductive drums 11BK, 11Y, 11M, and 11C, respectively.

The fixing unit 35 includes a fixing roller R1 that incorporates a heat generating element, e.g., a halogen lamp and a back-up roller R2 pressed against the fixing roller R1 under pressure.

The image forming units 10BK, 10Y, 10M, and 10C includes the photoconductive drums 11BK, 11Y, 11M, and 11C, charging sections or charging devices or charging rollers 12BK, 12Y, 12M, and 12C, developer bearing bodies or developing rollers 16BK, 16Y, 16M, and 16C, developer cartridges or toner cartridges 15Bk, 15Y, 15M, and 5C that hold toners of corresponding colors, developing layer forming members or developing blades 17BK, 17Y, 17M, and 17C, developer supplying members or toner supplying rollers 18BK, 18Y, 18M, and 18C, and cleaning members or cleaning blades 19BK, 19Y, 19M, and 19C.

The photoconductive drums 11BK, 11Y, 11M, and 11C each have an outer diameter of 30 mm. The cleaning blade 19BK, 19Y, 19M, and 19C have a rubber thickness of 1.6 mm and a free length of greater than 6.9 mm. Alternatively, the cleaning blade 19BK, 19Y, 19M, and 19C may have a thickness of less than 1.6 mm and not greater than 2.0 mm, a free length not less than 6.5 mm and not greater than 7.8 mm. The cleaning blades 19BK, 19Y, 19M, and 19C employ a polyurethane elastomer as a base material. An additive is added to the polyurethane elastomer to modify the characteristics of the cleaning blade. The cleaning blades 19BK, 19Y, 19M, and 19C are mounted to press the photoconductive drums 11BK, 11Y, 11M, and 110 under a pressure of 15 gf/cm but not higher than 60 gf/cm, and a cleaning angle of equal to or higher than 9 degrees but not greater than 14 degrees. Cleaning angle θ is an angle formed between the cut surface S of the cleaning blade 19BK and a plane tangent to the photoconductive drum at a point at which the cleaning blade contacts the circumferential surface of the photoconductive drum.

The toner used in this embodiment is a pulverized toner having an average particle diameter of 5.7 μm. The additive is a mixture of melamine, large particle silica, and small particle silica. The melamine is in an amount of 0.3 wt % based on 100 wt % of the toner. The mixture of large particle silica and small particle silica is in an amount of 3.95 wt % based on 100 wt % of the toner. The melamine, large particle silica, and small particle silica have average particle diameters of 150 nm, 40 nm, and 12 nm, respectively.

The controlling section of the aforementioned printer will be described.

Figure 2:
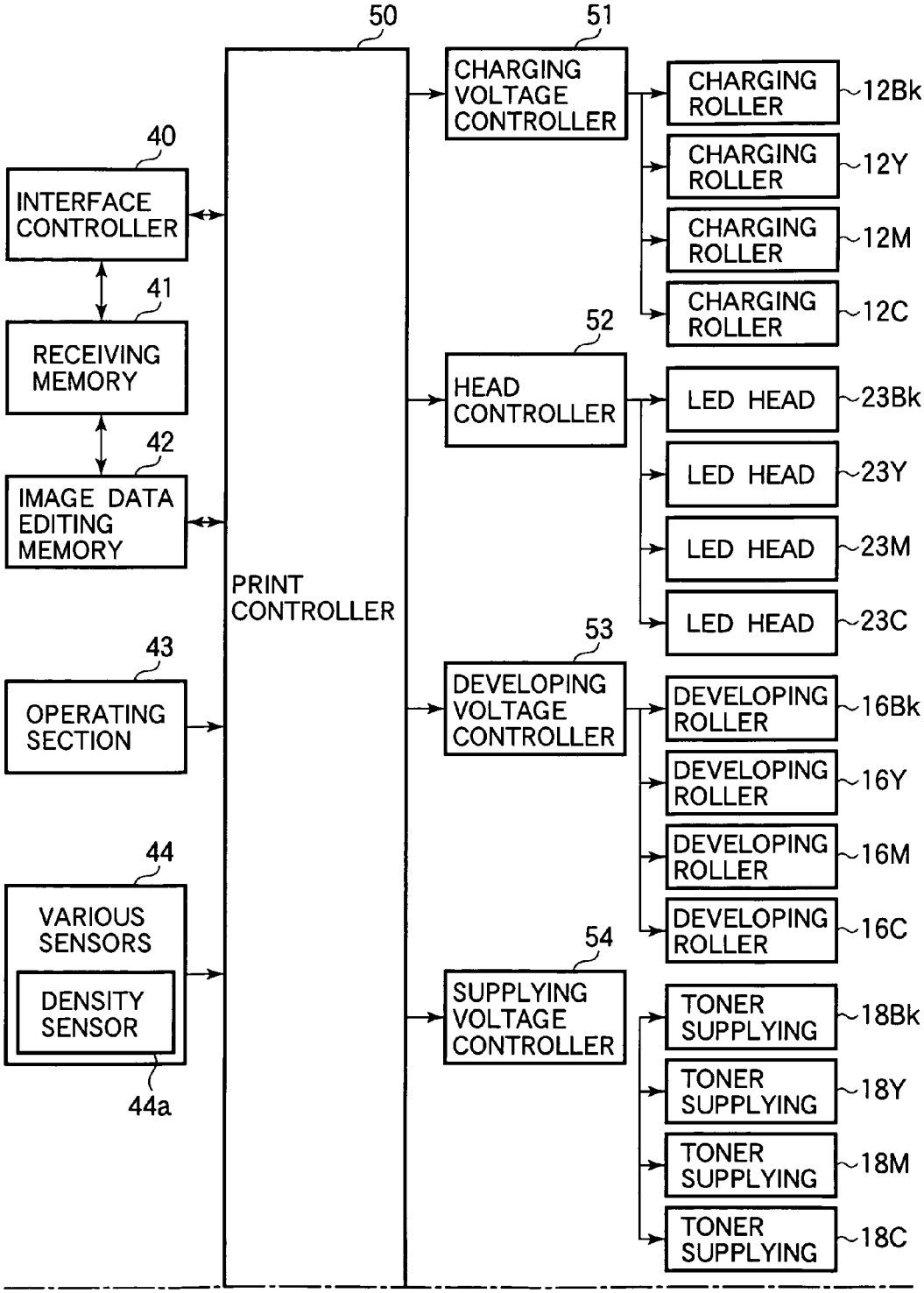
FIG. 2 is a first portion of a controlling section.
Figure 3:
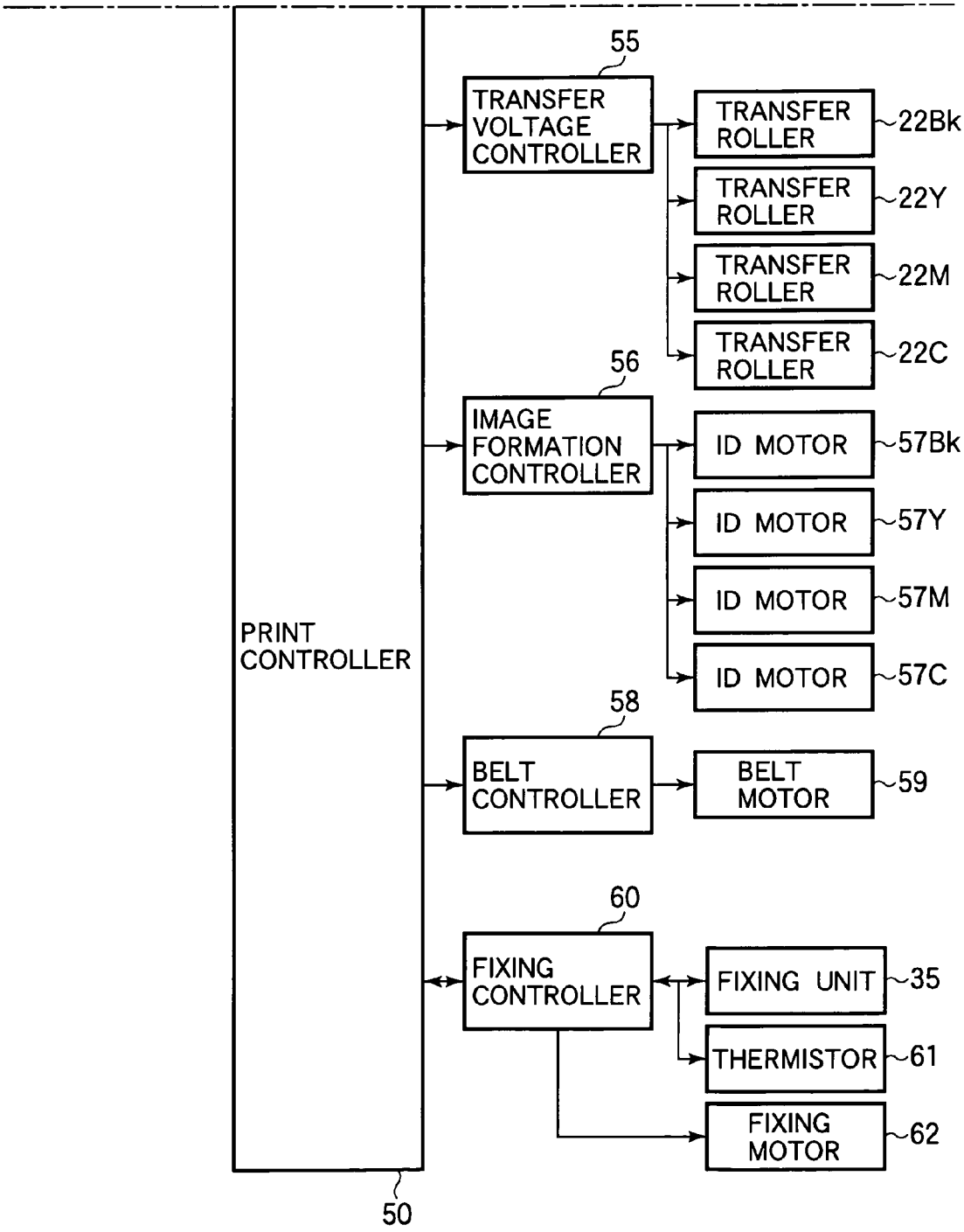
FIG. 3 is a second portion of the controlling section.

FIG. 2 is a first portion of the controlling section and FIG. 3 is a second portion of the controlling section.

Referring to FIGS. 2 and 3, a print controller 50 includes a microprocessor, a ROM, a RAM, and I/D port, and a timer (all not shown). The print controller 50 receives commands and print data from a host apparatus (not shown), and performs the overall sequence control of the printer for printing.

An interface controller 40 transmits information on the printer status to the host apparatus, or parses commands received from the host apparatus, thereby processing the print data received from the host apparatus. A receiving memory 41 separates the print data in terms of colors under control of the interface controller 40 to provide image data for the respective colors, and temporarily holds the image data therein. An image data editing memory 42 receives the print data from the interface controller 40 and is used for editing the print data. The edited print data is then sent from the image data editing memory 42 to the LED heads 23BK, 23Y, 23M, and 23C. An operating section 43 includes LEDs (not shown) as indicators for indicating the status of the printer and switches (not shown) operated by an operator to command the printer. Various types of sensors 44 include a density sensor 44*a* for detecting the density of a toner image and a plurality of position sensors (not shown) for detecting the position of print paper in a transport path. The outputs of the sensors 44 are sent to the print controller 50.

A charging voltage controller 51 applies voltages to the charging rollers 12BK, 12Y, 12M, and 12C in response to a command from the print controller 50, and performs controls for uniformly charging the surfaces of the photoconductive drums 11BK, 11Y, 11M, and 11C. A head controller 52 controls the LED heads 23BK, 23Y, 23M, and 23C to illuminate the charged surfaces of the photoconductive drums 11BK, 11Y, 11M, and 11C, thereby forming electrostatic latent images of corresponding colors on the photoconductive drums 11Bk, 11Y, 11M, and 11C. A developing voltage controller 53 controls the voltages applied to the developing rollers 16BK, 16Y, 16M, and 16C to supply the toner to the respective electrostatic latent images formed on the photoconductive drums 11BK, 11Y, 11M, and 11C. A supplying voltage controller 54 controls the voltages applied to the toner supplying rollers 18BK, 18Y, 18M, and 18C to supply the charged toner to the surfaces of the developing rollers 16Bk, 16Y, 16M, and 16C, respectively. A transfer voltage controller 55 controls in response to the command from the controller 50 the voltages applied to the transfer rollers 22BK, 22Y, 22M, and 22C, thereby transferring the toner images formed on the photoconductive drums 11BK, 11Y, 11M, and 11C onto the print paper.

An image formation controller 56 controls ID motors 57BK, 57Y, 57M, and 57C to drive the photoconductive drums 11BK, 11Y, 11M, and 11C, charging rollers 12BK, 12Y, 12M, and 12C, and developing rollers 16BK, 16Y, 16M, and 16C in rotation. A belt controller 58 controls a belt motor 59 in response to the command from the print controller 50, thereby causing the transfer belt 24 to run. A fixing controller 60 controls the voltage applied to a heater of the fixing unit 35 in response to the command from the print controller 50, thereby fixing the color toner images on the print paper. The fixing controller 60 receives a temperature reading or temperature information from a temperature detector or a thermistor 61 that detects the temperature of the fixing unit 35, and operates to turn on and off the heater in accordance with the temperature information. When the fixing unit 35 has reached a predetermined temperature, the fixing controller 60 controls a fixing motor 62 to rotate, thereby driving the fixing roller R1 in rotation.

The operation of the printer of the aforementioned configuration will be described.

The charging rollers 12BK, 12Y, 12M, and 12C charge the surfaces of the photoconductive drums 11BK, 11Y, 11M, and 11C, respectively. The image data editing memory 42 sends image data to the LED heads 23BK, 23Y, 23M, and 23C. Then, the LEDs of the LED heads 23BK, 23Y, 23M, and 23C are energized to illuminate the charged surfaces of the photoconductive drums 11BK, 11Y, 11M, and 11C, respectively, in accordance with the image data to form electrostatic latent images of corresponding colors on the corresponding photoconductive drums 11BK, 11Y, 11M, and 11C.

Subsequently, the thin layers of toner are formed on the developing rollers 16BK, 16Y, 16M, and 16C. The developing rollers 16BK, 16Y, 16M, and 16C receive voltages, and supply the toners of corresponding colors to the electrostatic latent images to form toner images.

The developing blades 17BK, 17Y, 17M, and 17C receive predetermined voltages, so that the toner particles of the toner layers acquire a predetermined amount of charge.

Subsequently, the transfer rollers 22BK, 22Y, 22M, and 22C receive voltages and transfer the toner images formed on the photoconductive drums 11BK, 11Y, 11M, and 11C onto the print paper one over the other in registration. Thereafter, the toner images on the print paper are fixed into the print paper by the fixing unit 35. The cleaning blades 19BK, 19Y, 19M, and 19C scrape residual toner from the photoconductive drums 11BK, 11Y, 11M, and 11C, respectively, after transfer of the toner images. The aforementioned cycle of image formation is repeated to print on a plurality of pages of print paper.

The surfaces of the photoconductive drums 11BK, 11Y, 11M, and 11C are in friction contact with the developing roller 16BK, 16Y, 16M, and 16C, transfer belt 24, print paper, and cleaning blades 19BK, 19Y, 19M, and 19C during each cycle of image formation. If stick-slip motion occurs between the photoconductive drums 11BK, 11Y, 11M, and 11C and the cleaning blades 19BK, 19Y, 19M, and 19C, then the additives (e.g., silica and charge control agent) on the surfaces of the toner particles detach from the toner particles and are deposited to the surfaces of the photoconductive drums 11BK, 11Y, 11M, and 11C. Also, wax contained in the toner particles elutes to adhere to the surfaces of the photoconductive drums 11BK, 11Y, 11M, and 11C, causing damage to the surfaces or filming (OPC filming) on the surfaces.

Stick-slip motion will be described by way of the cleaning blade 19BK for the sake of simplicity.

Figure 4:
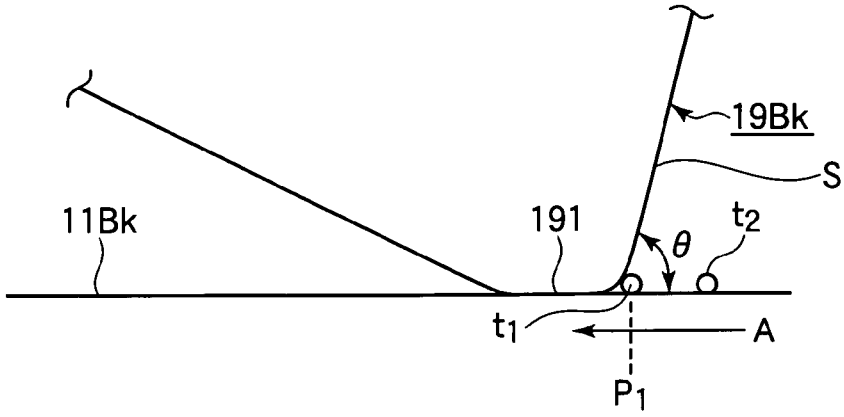
FIGS. 4-6 illustrate stick-slip motion of a cleaning blade.
Figure 5:
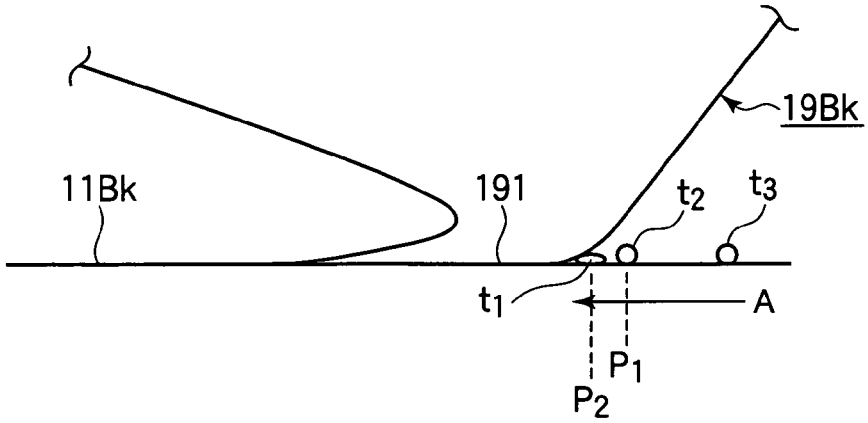
Figure 6:
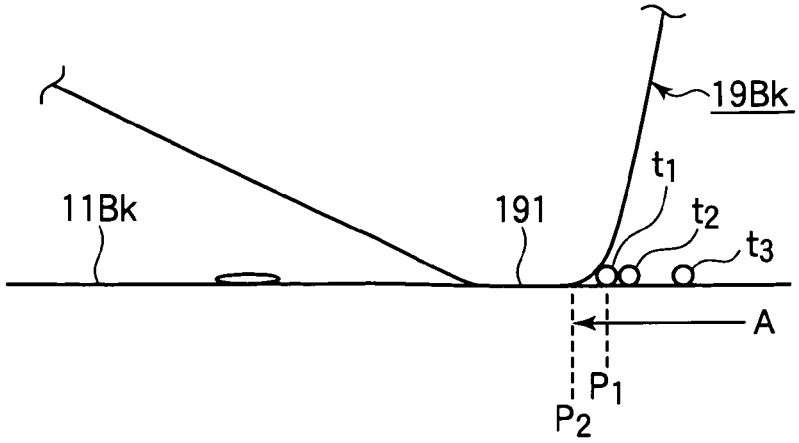

FIGS. 4-6 illustrate stick-slip motion.

Referring to FIGS. 4-6, a blade nip 191 is a contact portion of the blade 19BK at which the cleaning blade 19BK contacts the photoconductive drum 11BK.

As the photoconductive drum 11BK rotates, the surface of the photoconductive drum 11BK moves in a direction shown by arrow A, causing the blade nip 111 to deform as shown in FIG. 5, so that the blade nip is elongated in the direction as the surface of the photoconductive drum 11BK rotates. The elastomeric force or force of the blade nip 111 to slide back on the surface of the photoconductive drum increases as the blade nip 111 is stretched further. When the elastomeric force of the blade nip 111 to slide back overcomes the static frictional force between the blade surface and the photoconductive drum 11BK, the blade nip 111 begins to slide on the surface of the photoconductive drum 11BK. When the blade nip 111 begins to slide on the photoconductive drum 11BK, the dynamic friction coefficient between the blade nip 111 and the photoconductive drum 11BK is smaller than the static friction coefficient between them, so that the blade nip 111 can slide on the photoconductive drum 11BK, as shown in FIG. 6, back to where it was.

The cleaning blade 19BK stops the movement of the residual toner T and its external additives on the surface of the photoconductive drum 11BK to produce a buildup of residual toner, external additives, and debris immediately upstream of the cleaning blade 19BK.

As a result, the buildup of toner, external additives, and other debris such as paper particles are moved from the FIG. 4 state to the FIG. 5 state during stick-slip motion.

Then, the buildup of toner $t_1$ (including additives, and other debris such as paper particles) is pushed back against the movement of the surface of the photoconductive drum 11BK from a position P2 shown in FIG. 5 to a position P1 shown in FIG. 6 during stick-slip motion.

When stick-slip motion occurs during the rotation of the photoconductive drum 11BK, the residual toner T, external additives, and paper particles are subjected to frictional sliding motion on the photoconductive drum 11BK. Frictional sliding motion produces heat to melt the wax contained in the toner particles, the melted wax causing the residual toner T, external additive, and paper particles to become caked on the photoconductive drum 11Bk, thus forming filming on the photoconductive drum 11BK.

In the first embodiment, in order to minimize the chance of the cleaning blade 19BK of being subjected to stick-slip motion, the values of tan δ peak temperature and Young's modulus of the cleaning blade 19BK are specified, thereby minimizing filming.

Figure 7:
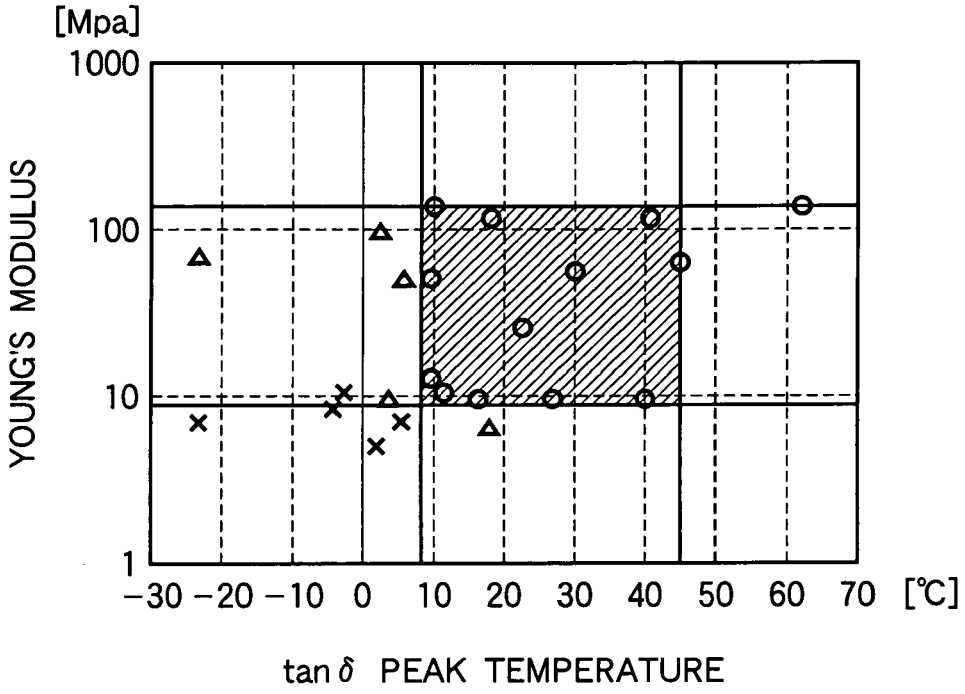
FIG. 7 illustrates filming and image quality when the cleaning blade of a first embodiment is used.

FIG. 7 illustrates filming and image quality when the cleaning blade of the first embodiment is used. FIG. 7 plots peak tan temperature as the abscissa and Young's modulus as the ordinate.

An experiment was conducted after the printer had been left for 12 hours in an ambient temperature and humidity environment of 22° C. and 50% RH.

Inspection was performed after printing a predetermined number of pages in continuous printing to determine whether filming occurs on the surface of the photoconductive drum 19BK, and evaluate image quality of a printed image at a density of 100%. The image quality was rated on a scale of 1-3 as shown in Table 1.

TABLE 1

| scale | Image Quality |
|---|---|
| 1 | No white spot appeared. |
| 2 | White spots of less than 0.5 mm appeared partially. |
| 3 | White spots not smaller than 0.5 mm appeared across the entire image. |

Referring to FIG. 7 and Table 1, numeral "1" indicates that no filming occurred and no white spot appeared. White spots are generally elliptic. Numeral "2" indicates that filming occurred partially and white spots having a diameter of less than 0.5 mm appeared. Numeral "3" indicates that prominent filming occurred and white spots having a diameter of larger than 0.5 mm (i.e., half the length of the major axis of the dot) appeared.

Evaluation was made using the Model MICROLINE 910PS printer (available from OKI DATA Inc.), the cleaning blade 19BK being replaced by a new, unused one before each experiment. The tan δ peak temperature of the cleaning blades 19BK was measured by measuring the dynamic viscoelasticity of the cleaning blade 19BK. The cleaning blade 19BK was formed of an elastic sheet of polyurethane, and Young's modulus of the cleaning blade 19BK was measured according to JIS K 6251.

Referring to FIG. 7, no filming occurred at tan δ peak temperatures equal to or higher than 8.6° C. and at Young's moduli equal to or higher than 8.8 Mpa. It is believed that this is because the cleaning blade 19BK partially loses its molecular chain mobility, so that the elasticity of the rubber material is lost (i.e., material is in a glass state).

Thus, the edge portion of the cleaning blade 19BK in a glass state and in contact with the surface of the photoconductive drum 11BK is difficult to stretch. Further, a large force is required to deform a rubber material having a high Young's modulus. Thus, the edge portion of the cleaning blade 19BK is difficult to deform. For these reasons, the cleaning blade 19BK in a glass state having a high Young's modulus is effective in minimizing filming.

A high molecular material having a Young's modulus higher than 140 Mpa is difficult to shape and therefore the cleaning blade 19BK having a Young's modulus higher than 140 Mpa was not tested.

No filming occurred at tan δ peak temperatures equal to or higher than 45° C. but chipping of the edge of the cleaning blade 19BK occurred. The chipping allows the residual toner T to escape through the gaps between the cleaning blade 19BK and the photoconductive drum 11BK. It is believed that the cleaning blade 19BK in a glass state is apt to be scratched and therefore its edge portion is abraded by the external additives and paper particles.

As described above, the cleaning blade 19BK of the first embodiment has a tan δ peak temperature equal to or higher than 8.6° C. and not higher than 45° C. and a Young's modulus equal to 8.8 Mpa and not higher than 140 Mpa, such that stick-slip motion may be minimized without resulting in chipping of the cleaning blade 19BK as well as minimizing the chance of filming occurring.

It is preferable to use the cleaning blade 19BK having a tan δ peak temperature equal to or higher than 8.6° C. and not higher than 45° C. and a Young's modulus equal to 8.8 Mpa and not higher than 140 Mpa in an ambient temperature and humidity (22° C./50% RH) environment. An experiment was conducted after the printer had been left in a low-temperature and low-humidity environment (10° C./20% RH) for about 12 hours, and revealed that the cleaning blade 19BK minimizes the chance of filming occurring only when Young's modulus is equal to or higher than 13 Mpa.

The Young's modulus of the cleaning blade 19BK tends to be lower in a low-temperature and low-humidity environment than in an ambient temperature and humidity environment. Assume that the cleaning blade 19BK has a Young's modulus of 8.8 Mpa, which is a low end of the range of Young's modulus in an ambient temperature and humidity environment. It is believed that when the printer is left in a low-temperature and low-humidity environment, the pressing force exerted by the cleaning blade 19BK on the photoconductive drum decreases as its Young's modulus increases, failing to minimize the stick-slip motion of the cleaning blade 19BK.

An experiment was conducted after the printer had been left in a high temperature and high-humidity environment (28° C./80% RH) for about 12 hours, and showed that if the cleaning blade 19BK has a Young's modulus of 8.8 Mpa or a lower end of the range of the range of Young's modulus in an ambient temperature and humidity environment.

The Young's modulus of the cleaning blade 19BK tends to be higher in a high-temperature and high-humidity environment than in an ambient temperature and humidity environment. Thus, if the cleaning blade 19BK having a Young's modulus of, e.g., 8.8 Mpa (lower end of the range of Young's modulus in an ambient temperature and humidity environment) is placed in a high-temperature and high-humidity environment, the Young's modulus of the cleaning blade 19BK increases to exert a larger pressing force on the photoconductive drum 11BK. It is believed that the increased pressing force minimizes the chance of stick-slip motion occurring.

Thus, taking environmental conditions under which the printer is operated, the cleaning blade 19BK preferably has a Young's modulus of equal to or higher than 13 Mpa and of less than 140 Mpa.

Second Embodiment

Elements similar to those of the first embodiment have been given the same reference numerals, and their description is omitted. Also, the description of the structures common to the first embodiment is omitted assuming that their operation and effects are substantially the same as those of the first embodiment.

In the first embodiment, the tan δ peak temperature and Young's modulus of a cleaning blade 19BK were specified to minimize stick-slip motion of the cleaning blade 19BK. In the second embodiment, the tan δ peak temperature and tensile strength of the cleaning blade 19BK are specified to minimize stick-slip motion of the cleaning blade 19BK.

Figure 8:
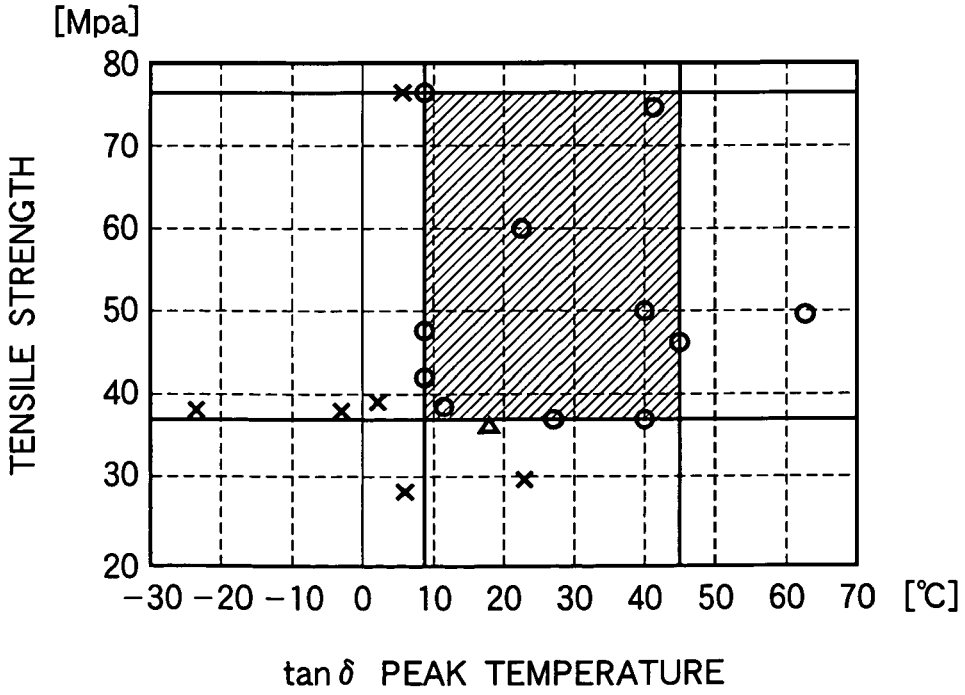
FIG. 8 illustrates the occurrence of filming and evaluation of image quality of a cleaning blade of a second embodiment.

FIG. 8 illustrates the occurrence of filming and evaluation of image quality of the cleaning blade of the second embodiment. FIG. 8 plots tan δ peak temperature as the abscissa and tensile strength as the ordinate.

An experiment was conducted after the printer has been left in an ambient temperature and humidity environment (22° C. and 50% RH) for about 12 hours. The tensile strength of an elastic sheet of polyurethane was measured according to JIS K 6251.

FIG. 8 shows that filming does not occur at tan δ peak temperatures equal to or higher than 8.6° C. and tensile strengths higher than 37.3 Mpa.

It is believed that not only the cleaning blade 19BK is in a glass state but also has a high tensile strength in the region shown in FIG. 8 so that increased stress acts, in a direction opposite to a direction in which the cleaning blade 19BK is stretched, to prevent the tip of the cleaning blade 19BK in contact with the photoconductive drum 11BK from stretching. This reliably minimizes stick-slip motion of the cleaning blade 19BK.

Also, FIG. 8 shows that filming occurs at tan δ peak temperatures lower than 8.6° C. even though the tensile strength is higher than 37.3 Mpa.

It is believed that stick-slip motion may not be minimized reliably because the cleaning blade 19BK is in a rubber state at tan δ peak temperatures lower than 8.6° C.

Also, filming does not occur at tan δ peak temperatures higher than 45° C. but chipping occurs in the tip of the cleaning blade 19BK. Therefore, the residual toner on the photoconductive drum 11BK escapes through the gaps between the cleaning blade 19BK and the photoconductive drum 11BK.

It is believed that the cleaning blade 19BK is in a glass state at tan δ peak temperatures higher than 45° C. and therefore the tip of the cleaning blade 19BK is apt to become scratched or abraded by the additive and paper particles.

If the tensile strength is equal to or higher than 76 Mpa, the tip of the cleaning blade 19BK becomes chipped off, so that the residual toner T escapes through the gaps between the cleaning blade 19BK and the photoconductive drum 11BK.

As described above, the cleaning blade 19BK of the second embodiment has a tan δ peak temperature equal to or higher than 8.6° C. and not higher than 45° C. and a tensile strength equal to or higher than 37.3 Mpa and not higher than 76 Mpa. Thus, stick-slip motion and filming may be minimized.

Third Embodiment

Elements similar to those of the first embodiment have been given the same reference numerals and their description is omitted. Also, the description of the structures common to the first embodiment is omitted assuming that their operation and effects are substantially the same as those of the first embodiment.

In the third embodiment, the tan δ peak temperature and hardness of a cleaning blade 19BK are specified, thereby minimizing the stick-slip motion of the cleaning blade 19BK.

Figure 9:
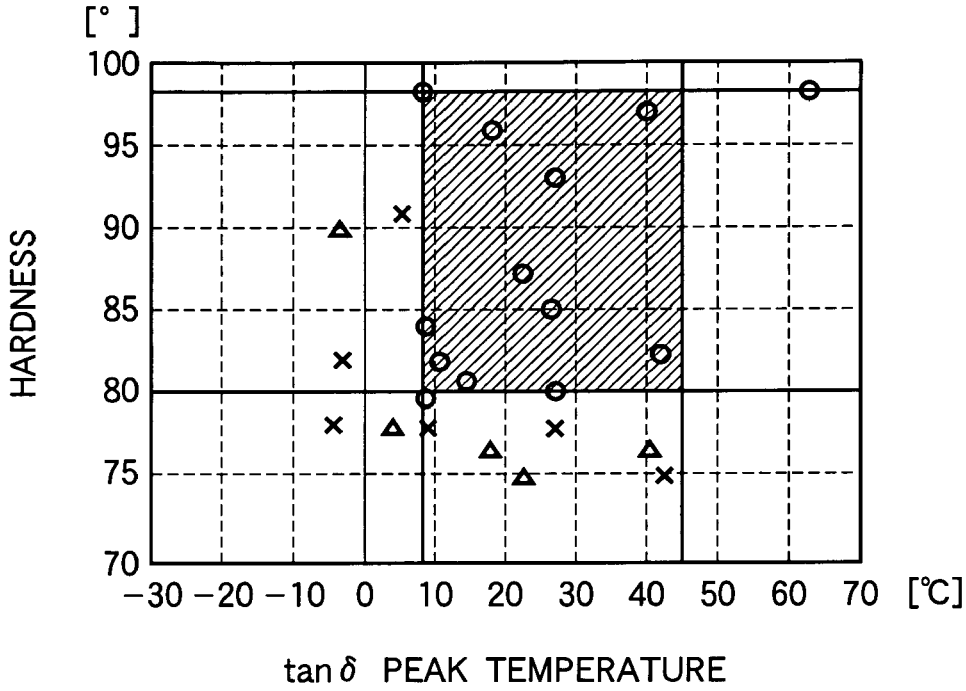
FIG. 9 illustrates the occurrence of filming and the evaluation of image quality when a cleaning blade of a third embodiment is used.

FIG. 9 illustrates the occurrence of filming and the evaluation of image quality when the cleaning blade 19BK of the third embodiment is used. FIG. 9 plots tan δ peak temperature as the abscissa and tensile strength as the ordinate.

An experiment was conducted after the printer has been left in an environment of 22° C. and 50% RH for about 12 hours. The tensile strength of an elastic sheet of polyurethane was measured according to JIS K 6253 in which the hardness is determined from the depth of a needle pressed against the surface of a test specimen via a spring.

The data shown in FIG. 9 reveal that no filming occurs if the cleaning blade has tan δ peak temperatures equal to or higher than 8.6° C. and harnesses higher than 80°.

If the cleaning blade 19BK has a high tan δ peak temperature and a high hardness and is in a glass sate, it exhibits good resistance to deformation. Therefore, the tip of the cleaning blade 19BK in contact with the surface of the photoconductive drum 11BK is difficult to deform, minimizing the chance of stick-slip motion of the cleaning blade 19BK occurring. A cleaning blade having a hardness higher than 97° was not tested because it is difficult to shape a_high molecular material.

Also, filming does not occur at tan δ peak temperatures higher than 45° C. but chipping occurs in the tip of the cleaning blade 19BK. Therefore, the residual toner T on the photoconductive drum 11BK escapes through the gaps between the cleaning blade 19BK and the photoconductive drum 11BK.

It is believed that the cleaning blade 19BK is in a glass state at tan δ peak temperatures higher than 45° C. and therefore the tip of the cleaning blade 19BK is apt to become scratched or abraded by the additive and paper particles.

As described above, the cleaning blade 19BK of the second embodiment has a tan δ peak temperature equal to or higher than 8.6° C. and lower than 45° C. and a hardness equal to or higher than 80° but lower than 97°. Therefore, stick-slip motion and filming may be minimized.

In the third embodiment, although it is preferable to use a cleaning blade having a hardness equal to or higher than 80° but lower than 97°. An experiment was conducted after the printer had been left in a low-temperature and low-humidity environment of 10° C. and 20% RH for 12 hours, and revealed that only a cleaning blade 19BK having a hardness of 83° was effective in preventing filming.

The hardness of the cleaning blade 19BK tends to be lower in a low-temperature and low-humidity environment than in an ambient temperature and humidity environment. Thus, if the cleaning blade 19BK having a hardness of, for example, 80° (lower end of the range of hardness in an ambient temperature and humidity environment) is placed in a low-temperature and low-humidity environment, the hardness of the cleaning blade 19BK decreases to exert a smaller pressing force on the photoconductive drum 11BK. It is believed that the decreased pressing force fails to reliably minimize the chance of stick-slip motion occurring.

An experiment was conducted after the printer had been left in a high-temperature and high-humidity environment (28° C./80% RH) for about 12 hours, and revealed that filming may be minimized in a high-temperature and high-humidity environment even if the cleaning blade 19BK has a hardness of 80° (lower end of the range of hardness in an ambient temperature and humidity environment).

The hardness of the cleaning blade 19BK tends to be higher in a high-temperature and high-humidity environment than in an ambient temperature and humidity environment. Thus, if the cleaning blade 19BK having a hardness of, for example, 80° (lower end of the range of hardness in an ambient temperature and humidity environment) is placed in a high-temperature and high-humidity environment, the hardness of the cleaning blade 19BK increases to exert a larger pressing force on the photoconductive drum 11BK. It is believed that the decreased pressing force is effective in minimizing stick-slip motion of the cleaning blade.

Taking environmental conditions into account, it is preferable that the cleaning blade 19BK has a hardness equal to or higher than 83° and lower than 97°.

Fourth Embodiment

Elements similar to those of the first embodiment have been given the same reference numerals and their description is omitted. Also, the description of the structures common to the first embodiment is omitted assuming that their operation and effects are substantially the same as those of the first embodiment.

In the fourth embodiment, the tan δ peak temperature and tearing strength of a cleaning blade 19BK are specified.

Figure 10:
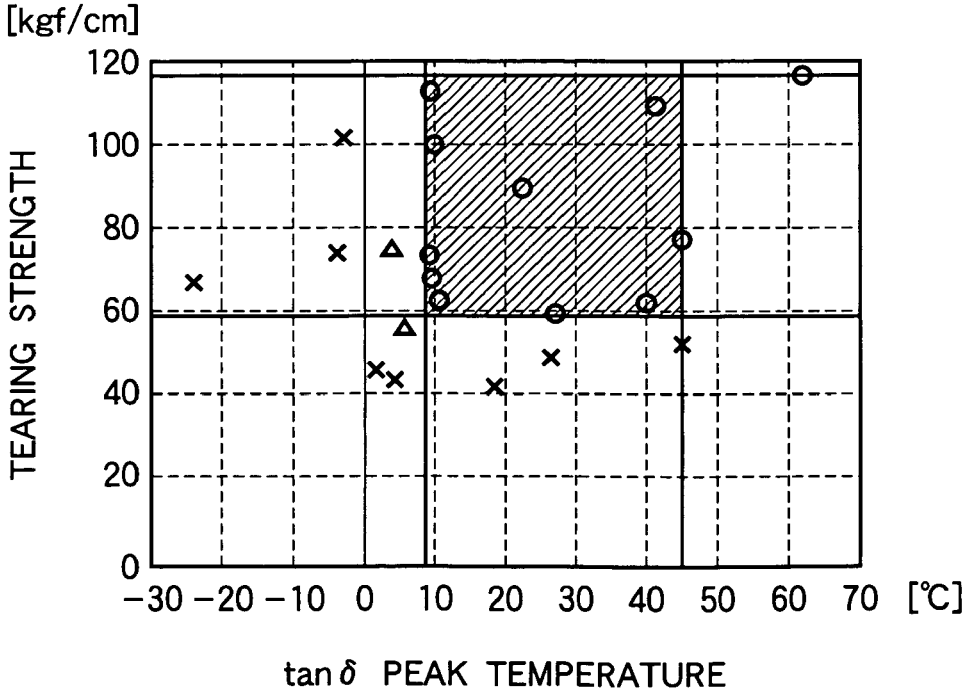
FIG. 10 illustrates the occurrence of filming and the evaluation of image quality when the cleaning blade of a fourth embodiment is used.

FIG. 10 illustrates the occurrence of filming and the evaluation of image quality when the cleaning blade 19BK of the fourth embodiment is used. FIG. 10 plots tan δ peak temperature as the abscissa and tearing strength as the ordinate.

An experiment was conducted after the printer has been left in an ambient temperature and humidity environment (22° C. and 50% RH) for about 12 hours. The tearing strength of an elastic sheet of polyurethane was measured according to JIS K 6252 in which the elastic sheet was pulled at a specified speed (500±25 mm/min) until the elastic sheet was torn apart. A maximum force required for the elastic sheet to be torn apart was measured.

The data shown in FIG. 10 reveal that no filming occurs at tan δ peak temperatures equal to or higher than 8.6° C. and tearing strengths of higher than 59 kgf/cm.

If the cleaning blade 19BK has a high tan δ peak temperature and a high tearing strength and is in a glass sate, it exhibits a large stress acting in a direction opposite to a direction in which the material is stretched. Therefore, the tip of the cleaning blade 19BK in contact with the surface of the photoconductive drum 11BK is difficult to stretch, minimizing the chance of stick-slip motion of the cleaning blade 19BK occurring.

A cleaning blade 19BK having a tearing strength higher than 118 kgf/cm was not tested because it is difficult to shape a high molecular material.

It is believed that filming does not occur but chipping occurs at tan δ peak temperatures higher than 45° C. and the residual toner T escapes through gaps between the cleaning blade 19BK and the photoconductive drum 11BK. It is believed that the cleaning blade 19BK is in a glass state and therefore the tip of the cleaning blade 19BK is apt to become scratched or braded by the additives and paper particles.

As described above, the cleaning blade 19BK of the fourth embodiment has a tan δ peak temperature equal to or higher than 8.6° C. and lower than 45° C. and a tearing strength equal to or higher than 59 kgf/cm and lower than 118 kgf/cm. Therefore, stick-slip motion and filming may be minimized.

The relationship between the tan δ peak temperature and the Young's modulus of the cleaning blade was described in the first embodiment. The relationship between the tan δ peak temperature and the tensile strength of the cleaning blade 19BK was described in the second embodiment. The relationship between the tan δ peak temperature and the hardness of the cleaning blade was described in the third embodiment. The relationship between the tan δ peak temperature and the tearing strength of the cleaning blade was described in the fourth embodiment.

Young's modulus is a measure of the deflection of the cleaning blade 19BK due to the pressing force acting between the cleaning blade 19BK and the photoconductive drum 11BK. Hardness is a measure of rigidity of a portion of the cleaning blade 19BK in contact with the photoconductive drum 11BK. Tearing strength is a measure of the stretching of a portion of the cleaning blade 19BK in contact with the photoconductive drum 11BK.

The configuration of the cleaning blade of the first embodiment may be combined with those of the second to fourth embodiments.

While the first to fourth embodiments have been described by way of a printer, the invention may also be applied to copiers, facsimile machines, and multi-function printers (MFP).

The invention being thus described, it will be obvious that the same may be varied in many ways. Such variations are not to be regarded as a departure from the scope of the invention, and all such modifications as would be obvious to one skilled in the art intended to be included within the scope of the following claims.

What is claimed is:

1. A cleaning blade disposed in an abutting relation with an image bearing body and configured to remove residual developer material from the image bearing body, the cleaning blade having:

a tan δ peak temperature equal to or higher than 8.6° C. and lower than 45° C.; and a Young's modulus equal to or higher than 8.8 Mpa and lower than 140 Mpa, wherein the cleaning blade is positioned at a cleaning angle in a range of 9 to 14 degrees with respect to a plane tangent to the image bearing body at a point at which the cleaning blade contacts a surface of the image bearing body.

2. The cleaning blade according to claim 1, wherein the Young's modulus is equal to or higher than 13 Mpa and lower than 140 Mpa.

3. An image forming apparatus incorporating the cleaning blade according to claim 2, wherein the image forming apparatus comprising:

a charging section for charging the image bearing body;

an exposing section for illuminating the charged image bearing body to form an electrostatic latent image;

a developing section for supplying a developer material to the electrostatic latent image to form a developer image;

a transfer section for transferring the developer image onto print medium; and a fixing section for fixing the developer image on the print medium.

4. The image forming apparatus according to claim 3, wherein the image bearing body is a photoconductive drum.

5. The image forming apparatus according to claim 4, wherein the photoconductive drum includes an aluminum core.

6. The cleaning blade according to claim 1, wherein the residual developer material is toner.

7. The cleaning blade according to claim 1, wherein the cleaning blade includes a base material of polyurethane elastomer.

8. An image forming apparatus incorporating the cleaning blade according to claim 1, wherein the image forming apparatus comprising:

a charging section for charging the image bearing body;

an exposing section for illuminating the charged image bearing body to form an electrostatic latent image;

a developing section for supplying a developer material to the electrostatic latent image to form a developer image;

a transfer section for transferring the developer image onto print medium; and a fixing section for fixing the developer image on the print medium.

9. The image forming apparatus according to claim 8, wherein the image bearing body is a photoconductive drum.

10. The image forming apparatus according to claim 9, wherein the photoconductive drum includes an aluminum core.

11. The cleaning blade according to claim 1, wherein the cleaning blade has a thickness in a range of 1.6 to 2.0 mm.

12. The cleaning blade according to claim 1, wherein the cleaning blade has a projected length in a range of 6.5-7.8 mm.

13. The cleaning blade according to claim 1, wherein the cleaning blade has a pressure force in a range of 15-60 gf/cm.

14. A cleaning blade disposed in an abutting relation with an image bearing body and configured to remove residual developer material from the image bearing body, the cleaning blade having:

a tan δ peak temperature equal to or higher than 8.6° C. and lower than 45° C.; and a tensile strength equal to or higher than 37.3 Mpa and lower than 76 Mpa, wherein the cleaning blade is positioned at a cleaning angle in a range of 9 to 14 degrees with respect to a plane tangent to the image bearing body at a point at which the cleaning blade contacts a surface of the image bearing body.

15. An image forming apparatus incorporating the cleaning blade according to claim 14, wherein the image forming apparatus comprising:

a charging section for charging the image bearing body;

an exposing section for illuminating the charged image bearing body to form an electrostatic latent image;

a developing section for supplying a developer material to the electrostatic latent image to form a developer image;

a transfer section for transferring the developer image onto print medium; and a fixing section for fixing the developer image on the print medium.

16. The image forming apparatus according to claim 15, wherein the image bearing body is a photoconductive drum.

17. The image forming apparatus according to claim 16, wherein the photoconductive drum includes an aluminum core.

18. A cleaning blade disposed in an abutting relation with an image bearing body and configured to remove residual developer material from the image bearing body, the cleaning blade having:

a tan δ peak temperature equal to or higher than 8.6° C. and lower than 45° C.; and a hardness equal to or higher than 80° and lower than 97°, wherein the cleaning blade is positioned at a cleaning angle in a range of 9 to 14 degrees with respect to a plane tangent to the image bearing body at a point at which the cleaning blade contacts a surface of the image bearing body.

19. The cleaning blade according to claim 18, wherein the hardness is equal to or higher than 83° and lower than 97°.

20. An image forming apparatus incorporating the cleaning blade according to claim 18, wherein the image forming apparatus comprising:

a charging section for charging the image bearing body;

an exposing section for illuminating the charged image bearing body to form an electrostatic latent image;

a developing section for supplying a developer material to the electrostatic latent image to form a developer image;

a transfer section for transferring the developer image onto print medium; and a fixing section for fixing the developer image on the print medium.

21. The image forming apparatus according to claim 20, wherein the image bearing body is a photoconductive drum.

22. The image forming apparatus according to claim 21, wherein the photoconductive drum includes an aluminum core.

23. A cleaning blade disposed in an abutting relation with an image bearing body and configured to remove residual developer material from the image bearing body, the cleaning blade having:

a tan δ peak temperature equal to or higher than 8.6° C. and lower than 45° C.; and a tearing strength equal to or higher than 59 kgf/cm and lower than 118 kgf/cm, wherein the cleaning blade is positioned at a cleaning angle in a range of 9 to 14 degrees with respect to a plane tangent to the image bearing body at a point at which the cleaning blade contacts a surface of the image bearing body.

* * * * *